United States Patent [19]

Sundquist

[11] 3,944,267

[45] Mar. 16, 1976

[54] CASKET LOCK STRUCTURE

[75] Inventor: Arvid M. Sundquist, Elgin, Ill.

[73] Assignee: Elgin Metal Casket Company, Elgin, Ill.

[22] Filed: Feb. 6, 1974

[21] Appl. No.: 440,016

[52] U.S. Cl. ..... 292/158; 292/139

[51] Int. Cl.[2] ..... E05C 1/08; E05C 1/16

[58] Field of Search ..... 292/139, 150, 156, 157, 292/158, 302, 167, 168; 70/208

[56] References Cited

UNITED STATES PATENTS

| | | | |
|---|---|---|---|
| 2,864,640 | 12/1958 | Mattinson | 292/158 |
| 3,403,432 | 10/1968 | Bencene | 292/302 |
| 3,745,796 | 7/1973 | Fleming | 70/208 |

*Primary Examiner*—Peter M. Caun

*Attorney, Agent, or Firm*—Kinzer, Plyer, Dorn & McEachran

[57] ABSTRACT

A casket lock structure for securing a casket top in a closed and sealed position. An elongated lock bar is slideably mounted inside the front of a casket. A connecting bar is pivotally mounted at one end to the lock bar and at the other end to an offset portion of a shaft extending through the wall of the casket such that rotation of the shaft causes a lateral translational movement of the lock bar. Striker pins fastened to the casket top are adapted to engage hook portions formed into the lock bar as the top is closed.

12 Claims, 7 Drawing Figures

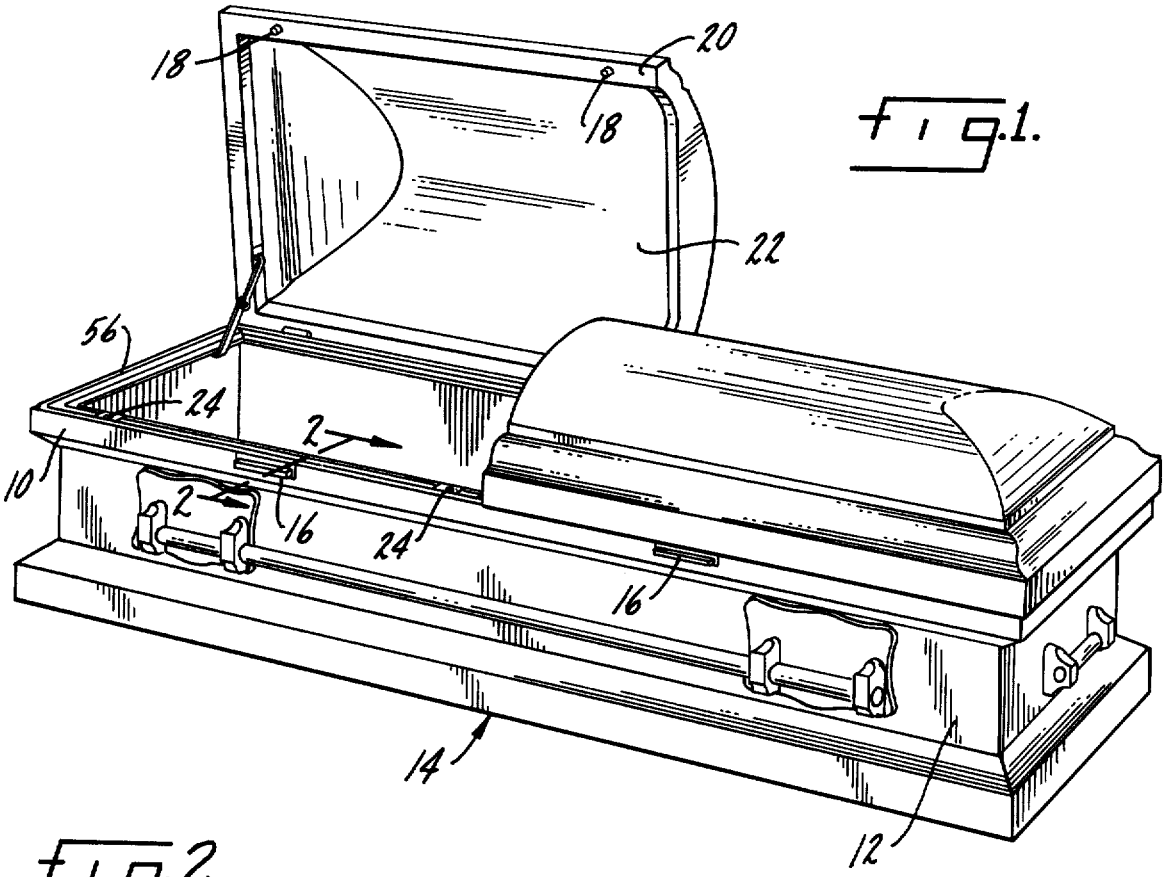
fig.1.
fig.2.
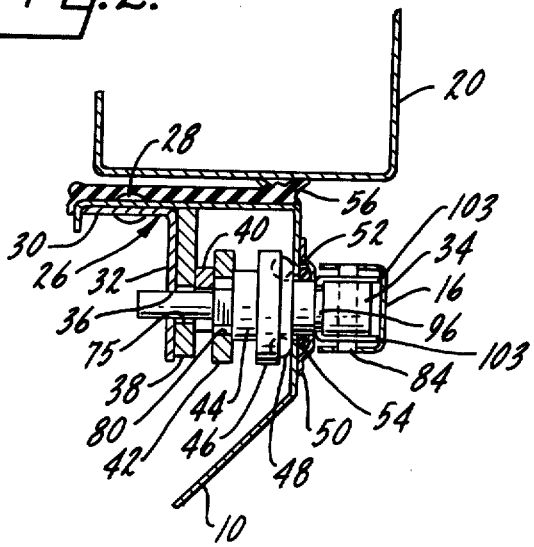
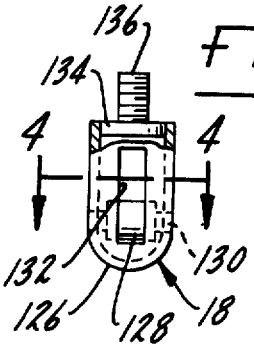
fig.3.
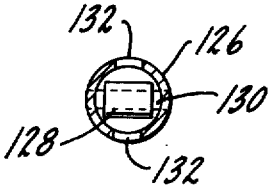
fig.4.

CASKET LOCK STRUCTURE

SUMMARY OF THE INVENTION

The present invention relates to lock mechanisms and, more particularly, to a lock structure for securing the top of a casket in a closed and sealed position.

A primary object of the present invention is a casket lock structure in which the operating parts combine to provide substantial leverage so that the force applied by the lock structure to close and seal the lid of a casket is substantially greater than the force applied to operate the lock structure.

Another object is a casket lock structure in which the leverage provided by the operating members is increased as the lock structure is closed, so that the greatest amount of force will be available to seal the casket top in its locked position.

Another object is a casket lock structure in which a snap-action closing effect is produced, in that once the lock structure is substantially closed, an additional internal force will be applied to complete the closing operation so as to return the structure to its locked position.

Another object is a casket lock structure having a unique striker fastened to the casket top for firmly engaging the remainder of the lock structure mounted along the casket wall.

Another object is a casket lock structure constructed to operate within a very limited height so that it may be substantially concealed within the flange of a casket wall.

Another object is a casket lock structure in which the operating member which passes through the casket wall carries a seal so as to prevent the entrance of moisture and the escape of air from the casket.

Another object is a casket lock structure in which every member is fixed in a stationary position when the structure is set in its locked position.

Other objects will appear in the ensuing specification, drawings and claims.

BRIEF DESCRIPTION OF THE DRAWINGS

FIG. 1 is a perspective view of a casket in which the present invention has been installed, FIG. 2 is a section along plane 2—2 of FIG. 1, FIG. 3 is a side view, partly in section, of the striker which is to be fastened to the flange of the top of a casket, FIG. 4 is a section along plane 4—4 of FIG. 3.

DESCRIPTION OF THE PREFERRED EMBODIMENT

Figure 5:
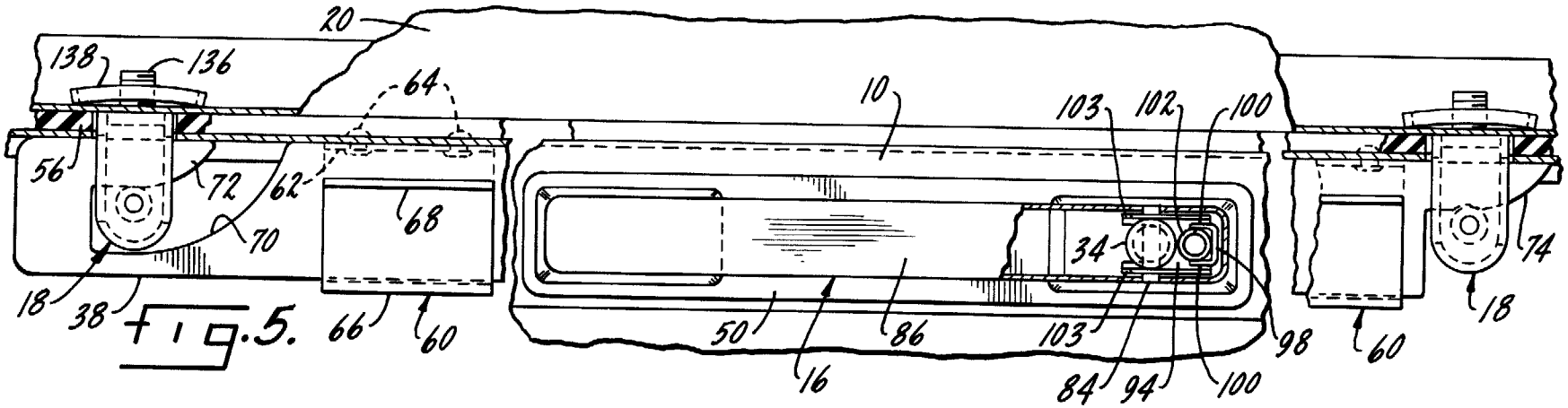
FIG. 5 is a partly fragmented front plan view, partly in section, of the lock structure in a closed and locked position.

In the present invention, a casket lock structure may be substantially enclosed within a flange 10 on the front wall 12 of a casket 14 as is shown in FIG. 1. Basically, the only externally visible portions of the lock are handle 16, strikers 18, which are fastened to flange 20 of casket top 22, and openings 24 in the top of casket flange 10 for receiving strikers 18.

In FIG. 2, a central bracket 26, which is fastened to the top of the casket flange 10 by a pair of rivets 28, has a flat horizontal portion 30 and a suspended vertical portion 32 which rotatably supports a shaft 34 within a circular hole 36. The shaft extends through a lock bar 38, connecting bar 40 and a cam plate 42, all of which are described in detail hereinbelow. An enlarged section 44 of the shaft 34 and a further enlarged section 46 are interposed between the cam plate 42 and the casket flange 10, with the outer annular face of section 46 being grooved to carry a seal 48 to seal against the inner surface of flange 10. A handle plate 50, which is fastened to the outer surface of flange 10, may have a recessed area 52 so as to receive another O-ring seal 54 about the shaft to provide an outer seal. The seals 48 and 54 are included to prevent the entrance of moisture and the escape of air from the casket.

A seal 56, shown in FIG. 2, is mounted along the top surface of casket flange 10 to seal against flange 20 of the casket top as the latter is closed.

Figure 6:
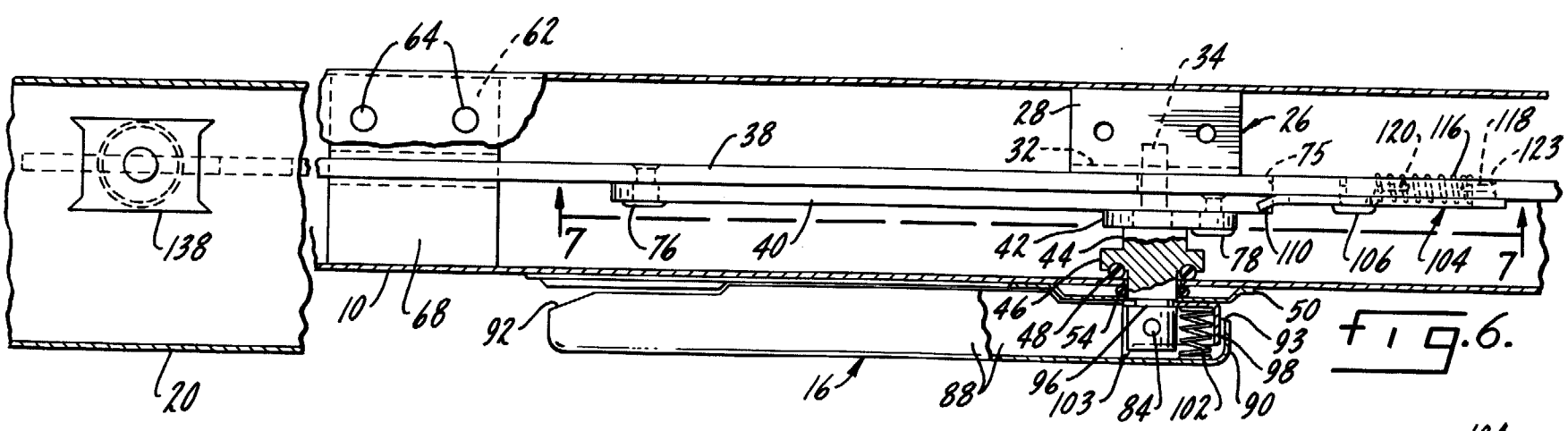
FIG. 6 is a top view partly in section of the structure of FIG. 5.
Figure 7:
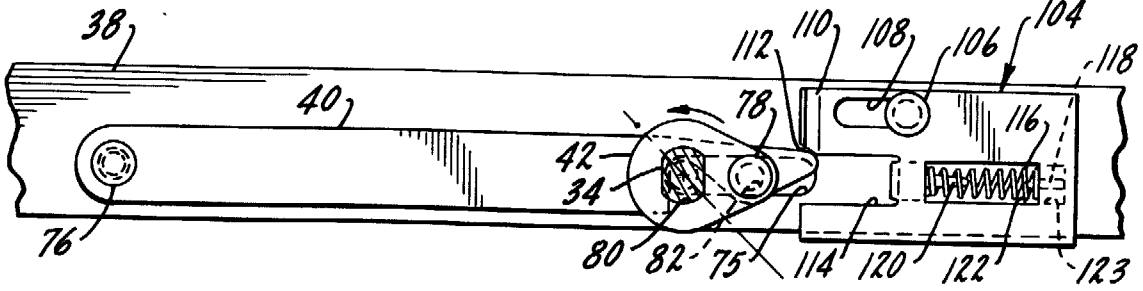
FIG. 7 is a section along plane 7—7 of FIG. 6.

Referring to FIGS. 5–7, lock bar 38 is slideably mounted within spaced side brackets 60. Each bracket 60 has a flat top portion 62, which is fastened to the underside of casket flange 10 by a pair of rivets 64, and a vertical suspended portion 66 which is folded generally in half to form a channel having a width slightly greater than that of lock bar 38. In addition, a flange 68 is formed along the free end of the bracket 60 to provide added strength therefore.

The lock bar 38 is an elongated rigid plate. An arcuate groove 70, which is cut into one end of lock bar 38, partially defines a hook portion 72, the function of which will be described below. A similarly shaped hook portion 74 extends from the other end of the lock bar 38. A longitudinal slot 75 is cut out of the lock bar to receive shaft 34 and to allow the lock bar to be longitudinally reciprocated over stationary shaft 34.

Connecting bar 40 is pivotally connected to lock bar 38 at a point longitudinally offset to the left of shaft 34 by a rivet 76. The other end of the connecting bar is rotatably mounted by means of a rivet 78 to cam plate 42 at a point radially offset from the axis of shaft 34. Connecting bar 40 is likewise an elongated plate of rigid material, but shorter in length than lock bar 38.

Cam plate 42 is rigidly carried by shaft 34 between connecting bar 40 and enlarged section 44. A cam plate hole 80, which has partially straight parallel sides, is adapted to receive a similarly shaped portion of shaft 34, to prevent rotation of the shaft relative to the cam plate. Another hole 82, offset from the hole 80, is adapted to receive rivet 78 for pivotally fastening one end of the connecting bar 40 thereto.

Handle 16 which acts as a crank for rotating shaft 34 is mounted to the outer end thereof by a wrist pin 84. The handle has a generally rectangular flat outer surface 86 and integral inwardly extending upper and lower surfaces 88 and end surfaces 90. The inner edges of the upper and lower surfaces 88 are contoured to match the outer surface of handle plate 50, against which the handle rests when disposed in its locked position. The inner corner 92 of the free end of the handle 16 is tapered away from handle plate 50 so as to provide a gripping surface for pulling the free end of the handle away from the handle plate in order to operate the lock structure. The opposite end of handle 16 has a stop surface 93 which limits the outward pivotal movement of handle 16. A bracket 94, which is disposed within the other end of handle 16, extends about an undercut portion or annular groove 96 in the shaft 34 thereby fixing the position of the shaft in relation to casket wall 10 and handle plate 50. An extension 98 of the bracket 94 is bent toward outer surface 86 of the handle and has two flanges 100 directed toward shaft 34 to partially enclose a spring 102 which pivotally urges the free end of handle 16 to a position parallel to but spaced from handle plate 50. A stop member 103 on bracket 94 limits the inward rotation of handle 16 so as to prevent contact.

Referring to FIG. 7, locking bracket 104 is slideably mounted along lock bar 38 on the same side as the connecting bar 40 by pin 106 and slot 108. End portion 110, which faces connecting bar 40, is bent at an angle away from lock bar 38. In addition, the bottom edge is tapered upward so as to form contact surface 112 for engagement with the end of connecting rod 40 when the rod is nearly in its clocked position. Slot 114 is cut into the bracket to receive the end of connecting rod 40 and spring 116 urges the locking bracket toward said connecting bar. One end of spring 116 overlies and encircles tooth 118 formed in lock bar 38 and the other end of the spring overlies and encircles similar tooth 120 formed in locking bracket 104. Because locking bracket 104 and lock bar 38 have mutually contacting surfaces, longitudinal slots 122 and 123 respectively must be formed in each to provide space for spring 116.

Referring to FIGS. 3–5, striker 18 is mounted on the casket top for engaging each hook portion 72 and 74 of lock bar 38. A cup-shaped housing 126 has roller 128 mounted on striker pin 130 supported within and across cup 126. Two diametrically opposed vertical slots 132 are cut out of the walls of the cup, with the slots being aligned along a diameter normal to the axis of striker pin 130. Cover 134 extends across the top of housing 126 and has an integral threaded extension 136 for engaging flange 20 of casket top 22. Threaded extension 136 is secured to flange 20 by a bowed nut 138, the function of which is explained below.

The use, operation and function of the invention are as follows:

In order to close and lock top 22 of casket 14, the free end of handle 16 is pivoted outward about wrist pin 84, so that the handle can be used as a crank to rotate shaft 34 in a counterclockwise direction. Cam plate 42 rotates with shaft 34 and causes one end of connecting bar 40 to travel along a semi-circular path as it rotates about rivet 78. The other end of the connecting rod is constrained by the pivotal connection to lock bar 38 to a horizontal linear movement. Thus the rotation of shaft 34 will cause a lateral translational displacement of the other end of connecting bar 40 and lock bar 38, both being displaced to the left as viewed in FIGS. 5 and 6. When handle 16 has been rotated through generally 135°, the open end of groove 70 will be aligned with opening 24 in casket flange 10. As casket top 22 is closed onto flange 10, strikers 18 will be received into the openings 24. Clockwise rotation of the handle will then cause lock bar 38 to be displaced to the right. Such lateral displacement of lock bar 38 will cause hook portions 72 and 74 to enter vertical slots 132 of strikers 18. As the bottom curved surface of the hook portions bear against rollers 128 on striker pins 130, the striker and top flange 20 to which it is secured will be drawn following the curve of the hook portions. As handle 16 is almost returned to the horizontal position, inclined surface 112 of locking plate 104 will bear against the end of connecting rod 40 and provide an additional internal downward thrust to effectively snap connecting bar 40 into its closed and locked position.

Cam plate 42, connecting bar 40 and lock bar 38 are so constructed and arranged relative to one another that the maximum force will be applied to close the lid and thus seal the casket. Looking at FIGS. 5 and 7, it can be seen that when rivet 78 which joins cam plate 42 and connecting bar 40 is at 10:30 o'clock relative to the axis of the shaft, or 45° to the left of the vertical, a great amount of handle rotation will produce a small lateral displacement of the lock bar 38. However, rollers 128 of striker pins 130 will engage the outermost surface of the hook portions when cam plate 42 is in this position. Because the slope of the bottom surface of hook portions 72 and 74 is greatest near the top of the lock bar and approaches the horizontal as the said bottom surface curves into the lock bar, even a small initial rightward displacement of the lock bar will cause a substantial downward displacement of the striker pins 130 and thus the casket top. When the cam rivet is at 12 o'clock, the greatest linear displacement of the lock bar will be produced by a given rotation of the shaft. However, when the cam rivet approaches the 3 o'clock position the greatest amount of shaft rotation will produce the smallest linear displacement of lock bar 38 and the minimum slope of hook portions 72 and 74 will bear against strikers 18. Thus the angular position of the cam plate and related slope of the lock bar hook portions combine to provide substantial leverae in applying the force exerted on the handle to the downward closing force applied to the strikers of the casket top. The last angular displacement of the handle will thereby cause only a minimum downward displacement of the casket top. This latter minimum depression of the casket top can be effectively used to simply force the already closed top 22 into seal 56 disposed between the flanges of the casket walls and top.

In addition, an internal force will be applied to return connecting bar 40 to its locked position. Right near the end of the movement of the connecting bar as it is returning to the horizontal position, it will bear against inclined surface 112 on locking bracket 104. This will cause the connecting bar to be rapidly moved back to its horizontal locked position because bracket 104, under force of spring 116, will provide a downward thrust on the connecting bar. This snap type action returns the handle to its horizontal position once it is almost brought to that position.

Strikers 18 are constructed to form a rigid connection with lock bar hooks 72 and 74. As a striker is engaged by a hook, roller 128 bears against the bottom surface of the hook and the housing 126 bears against the lower surface of the groove associated with that hook, if any. Even for hook 74 at the end of lock bar 38, vertical slots 132 are completely filled by hook portion 174 so that there is no vertical play in such a connection. The slope of the hooks prevent any longitudinal freedom of movement and the width of slots 132 prevents any lateral play although both of these latter movements are more significantly restrained by the construction of the hinges of the casket top.

Nut 138 of the striker has a bow to it, not only to provide some tension to firmly hold the striker to the flange of the casket top, but also to accurately align slots 132 with the hook portions of the lock bar. The striker may have to be rotated through a fraction of additional turn once it is secured to the flange in order to make such an alignment. The tension provided by the bow in nut 138 permits slack to allow exact alignment.

In furtherance of the aesthetic features of casket construction, all of the operating portions of the casket lock structure of the present invention are constructed to operate within a space having a maximum vertical height of approximately 1⅛ inch. The structure can therefore be concealed within the flange on the front wall of a casket.

Whereas the preferred form of the present invention has been shown and described herein, it should be realized that there may be many modifications, alterations and substitutions thereto.

I claim:

1. A casket lock structure for securing a casket top in a closed and sealed position comprising:

an elongated lock bar and means for slidably mounting it along a casket wall, said bar having at least one hook portion;

a shaft to be rotatably supported through the casket wall at a point intermediate the length of the lock bar;

means for rotating said shaft;

a connecting bar having one end pivotally mounted to the lock bar at a point laterally offset from said shaft, offset means on said shaft being so associated with the other end of the said connecting bar that rotation of said shaft causes a lateral translational movement of the said one end of the connecting bar and, in turn, the lock bar to which it is mounted; and, means associated with the casket top for engaging said hook portion of the lock bar as the top is closed;

said lock structure having a locked position corresponding to the closed and sealed position of the casket top; and said lock bar, connecting bar and offset means being so connected and arranged relative to one another that the angular displacement of the handle required to produce a small uniform downward displacement of the casket top increases as the lock structure approaches its locked position, thereby increasing the leverage of shaft rotation to lock bar translation so as to maximize the closing force applied to the casket top as it approaches its closed and locked position.

2. The casket lock structure of claim 1 further characterized in that said offset means on the shaft comprises a cam plate rigidly mounted on said shaft and generally normal to the axis thereof, with the said other end of the connecting bar being rotatably connected to said cam plate at a point radially offset from the shaft extending therethrough.

3. The structure of claim 1 further characterized in that the means for engaging each hook portion of the lock bar includes a cup-shaped striker having a pin mounted thereacross and fastening means for attachment to the casket top.

4. The structure of claim 1 further characterized in that the means for engaging each hook portion of the lock bar includes a cup shaped striker with a pin mounted thereacross, said striker having two diametrically opposed vertical slots, aligned along a diameter normal to the axis of said pin, for receiving said hook portion, and a cover at the top of the striker having a threaded extension for engaging the flange of the casket top.

5. The structure of claim 3 further characterized by and including a bowed nut cooperating with the threaded extension of the striker to firmly hold the striker to the flange of the casket top, the bow of said nut permitting limited rotation of the striker after it has been secured to the flange so as to align the slots in the striker with the hook portion of the lock bar.

6. The structure of claim 3 further characterized by and including a cylindrical roller mounted on said pin so as to roll along the surface of said hook portion as the same is engaged by the striker.

7. The structure of claim 1 further characterized by a curved groove in said lock bar, partially defining a bottom surface of said hook portion such that the slope of the bottom surface is greatest near the top of the lock bar and approaches the horizontal as the said bottom surface curves into the lock bar, said curved groove being adapted to receive said means for engaging each hook portion and thereby to provide additional closing leverage.

8. The structure of claim 1 further characterized by an enlarged section of said shaft between the cam plate and outer casket wall, the face of said enlarged section being adapted to hold an annular seal against the casket wall to prevent the entrance of moisture and the escape of air from the casket.

9. The structure of claim 1 further characterized in that the means for rotating said shaft comprises a handle pivotally mounted on the end of said shaft by a wrist pin extending therethrough.

10. A casket lock structure for securing a casket top in a closed and sealed position comprising:

an elongated lock bar and means for slidably mounting it along a casket wall, said bar having at least one hook portion;

a shaft to be rotatably supported through the casket wall at a point intermediate the length of the lock bar;

means for rotating said shaft;

a connecting bar having one end pivotally mounted to the lock bar at a point laterally offset from said shaft, offset means on said shaft being so associated with the other end of said connecting bar that rotation of said shaft causes a lateral translational movement of the said other end of the connecting bar and, in turn, the lock bar to which it is mounted;

means associated with the casket top for engaging said hook portion of the lock bar as the top is closed; and a locking bracket slidably mounted along said lock bar, spring means urging said locking bracket toward the said other end of the connecting bar, said locking bracket having a slanted edge surface so that as the said other end of the connecting bar approaches the end of its rotational displacement, it will bear against the slanted edge portion of the locking bracket and be urged toward its final locked position.

11. The structure of claim 10 further characterized by a pin and slot connection for holding the locking bracket to said lock bar.

12. A casket lock structure for securing a casket top in a closed and sealed position comprising:

an elongated lock bar and means for slidably mounting it along a casket wall, said bar having at least one hook portion;

a shaft to be rotatably supported through the casket wall at a point intermediate the length of the lock bar;

a longitudinal slot in said lock bar, said slot permitting the translational displacement of the lock bar about said shaft which extends therethrough;

means for rotating said shaft;

a connecting bar having one end pivotally mounted to the lock bar at a point laterally offset from said shaft, offset means on said shaft being so associated with the other end of said connecting bar that rotation of said shaft causes a lateral translational movement of the said other end of the connecting bar and, in turn, the lock bar to which it is mounted;

means associated with the casket top for engaging said hook portion of the lock bar as the top is closed.

* * * * *